US006003414A

United States Patent [19]

Hsieh

[11] Patent Number: 6,003,414

[45] **Date of Patent: *Dec. 21, 1999**

[54] QUICK-RELEASE SOCKET ADAPTER

[76] Inventor: Chih-Ching Hsieh, No. 64, Lane 107, Liang Tsun Rd., Fong Yuan, Taichung Hsien, Taiwan

[ * ] Notice: This patent is subject to a terminal disclaimer.

[21] Appl. No.: 09/104,212

[22] Filed: Jun. 25, 1998

[51] Int. Cl.[6] ..... B25B 13/00

[52] U.S. Cl. ..... 81/177.85; 403/325; 403/328

[58] Field of Search ..... 81/177.2, 177.85; 403/322, 324, 325, 328

[56] References Cited

U.S. PATENT DOCUMENTS

| | | | |
|---|---|---|---|
| 4,614,457 | 9/1986 | Sammon | 403/322 |
| 4,962,682 | 10/1990 | Rose et al. | 81/177.85 |
| 5,390,571 | 2/1995 | Fox, III et al. | 81/177.85 |
| 5,531,140 | 7/1996 | Chow | 81/177.85 |

*Primary Examiner*—James G. Smith
*Attorney, Agent, or Firm*—Varndell & Varndell, PLLC

[57] ABSTRACT

A quick-release socket adapter includes a hollow elongated casing having a hollow polygonal coupling rod at one end for holding a socket, a hollow ratchet socket wrench coupling portion at an opposite end for coupling to a ratchet socket wrench, a spring, a stop rod inserted into the casing and forced by the spring to push a steel ball partially out of a radial locating hole on the polygonal coupling rod of the casing to lock the socket being mounted on the polygonal coupling rod of the casing, and a release control rod inserted through a transverse through hole on the ratchet socket wrench coupling portion of the casing and moved to lock/unlock the stop rod, the release control rod having a flank curved outwards on the middle ,the flank being engaged with a recessed top wall of a head at one end of the stop rod when the release control rod is moved to a first position in the transverse through hole on the ratchet socket wrench coupling portion of the casing, enabling the steel ball to be forced out of the radial locating into engagement with the socket mounted on the polygonal coupling rod of the casing, the stop rod being forced forwards by the flank when the release control rod is moved to second position in the transverse through hole on the ratchet socket wrench coupling portion, thereby causing the steel ball to fall in the radial locating hole away from the socket mounted on the polygonal coupling rod.

3 Claims, 12 Drawing Sheets

QUICK-RELEASE SOCKET ADAPTER

BACKGROUND AND SUMMARY OF THE INVENTION

The present invention relates to a socket adapter for coupling a socket to a ratchet socket wrench, and more particularly to a quick-release socket adapter which enables the loaded socket to be quickly released.

A variety of ratchet socket wrenches have been disclosed for grasping and turning bolts, nuts, etc., and have appeared on the market. FIG. 1 shows a conventional ratchet socket wrench for this purpose. When in use, the socket is coupled to the polygonal driving shaft of the ratchet socket wrench and secured thereto by a steel on in a radial hole on the polygonal driving shaft. When not in use, the socket is directly removed from the polygonal driving shaft of the ratchet socket wrench by force. FIG. 2 shows another structure of conventional ratchet socket wrench. This structure of ratchet socket wrench has a release button controlled to release the steel ball from the socket being coupled to the polygonal driving shaft of the ratchet socket wrench. FIGS. 3 and 4 show two socket adapters used for coupling a socket to a ratchet socket wrench. These two socket adapters commonly have a polygonal front end for holding a socket, and a steel ball moved in and out of a radial hole on the polygonal front end to lock the socket mounted on the polygonal front end. When not in use, the user must employ such effort to remove the loaded socket from the polygonal front end of the adapter. FIGS. 5, 6 and 7 show a socket adapter which enables the user to dismount the loaded socket with less effort. This structure of socket adapter comprises a longitudinal hole, a radial hole perpendicularly extended from the longitudinal hole to the periphery of the polygonal front end thereof, a rear coupling end for coupling to a ratchet socket wrench, a steel ball moved in and out of the radial hole for locking socket being mounted on the polygonal front end, a transverse hole intersecting the longitudinal hole, a stop rod inserted into the longitudinal hole, the stop rod having hooked portion at one end and a sliding way adjacent to the hooked portion, a spring mounted inside the longitudinal hole and stopped against one end of the stop rod, and a release control rod inserted into the transverse hole, the release control rod having a retaining portion for engagement with the hooked portion of the stop rod. The spring imparts a forward pressure to the stop rod, causing the hooked portion of the stop rod to be engaged with the retaining portion of the release control rod. When engaged, the steel ball is partially forced out of the radial hole to lock the loaded socket. When the release control rod is depressed, the stop rod is forced backwards to compress the spring, and to release the steel ball from the loaded socket, enabling the loaded socket to be removed from the polygonal front end of the adapter. This structure of socket adapter still has drawbacks. Because the location of the release control rod is near the polygonal front end and far away from the rear coupling end of the adapter, the user just holds the ratchet socket wrench with one hand and operate the release control rod with the other hand when unlocking the loaded socket. Another drawback of this structure of socket adapter is its complicated structure. Because the procedure of processing the retaining portion on the release control rod and the hooked portion and sliding way on the stop rod is complicated, the manufacturing cost of this structure of socket adapter is high.

It is one object of the present invention to provide a quick-release socket adapter for coupling a socket to a ratchet socket wrench which enables the loaded socket to be quickly released from the socket adapter. It is another object of the present invention to provide a quick-release socket adapter which can be conveniently operated with one hand to release the loaded socket. It is still another object of the present invention to provide a quick-release socket adapter which is inexpensive to manufacture. To achieve these and other objects of the present invention, there is provided a socket adapter comprised of a hollow elongated casing, the casing having a cylindrical base, a polygonal front end at one end of the cylindrical base for holding a socket, and a coupling portion at an opposite end of the cylindrical base for coupling to a ratchet socket wrench, a spring, a stop rod inserted into the casing and forced by the spring to push a steel ball partially out of a radial locating hole on the polygonal coupling rod of the casing to lock the socket being mounted on the polygonal coupling rod of the casing, and a release control rod inserted through a transverse through hole on the ratchet socket wrench coupling portion of the casing and moved to lock/unlock the stop rod, the release control rod having a flank curved outwards on the middle, the flank being engaged with a recessed top wall of a head at one end of the stop rod when the release control rod is moved to a first position in the transverse through hole on the ratchet socket wrench coupling portion of the casing, enabling the steel ball to be forced out of the radial locating into engagement with the socket mounted on the polygonal coupling rod of the casing, the stop rod being forced forwards by the flank when the release control rod is moved to a second position in the transverse through hole on the ratchet socket wrench coupling portion, thereby causing the steel ball to fall in the radial locating hole away from the socket mounted on the polygonal coupling rod.

DETAILED DESCRIPTION OF THE PREFERRED EMBODIMENT

Figure 1:
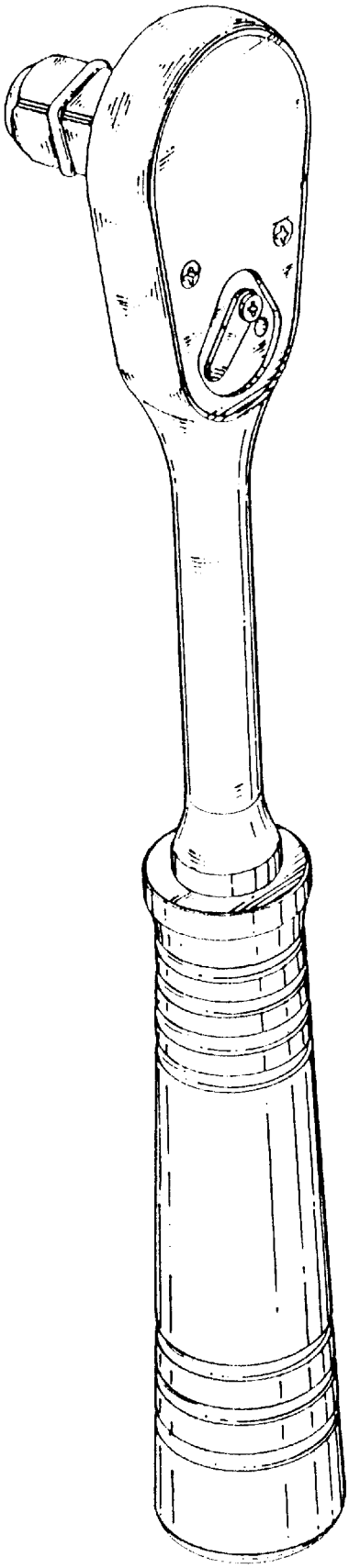
Fig . 1 PRIOR ART
FIG. 1 is a perspective view of a conventional ratchet socket wrench.
Figure 2:
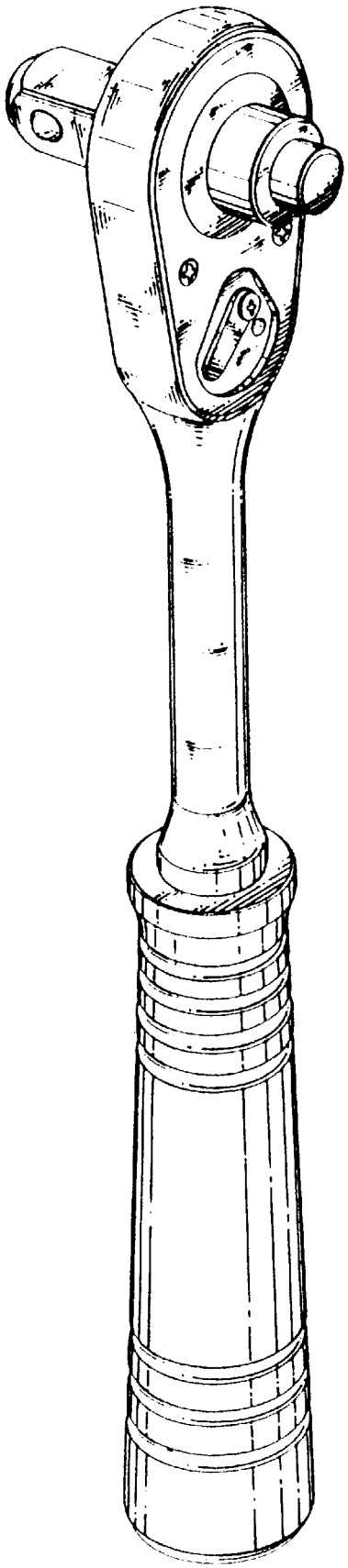
Fig. 2 PRIOR ART
FIG. 2 is a perspective view of another structure of conventional ratchet socket wrench.
Figure 3:
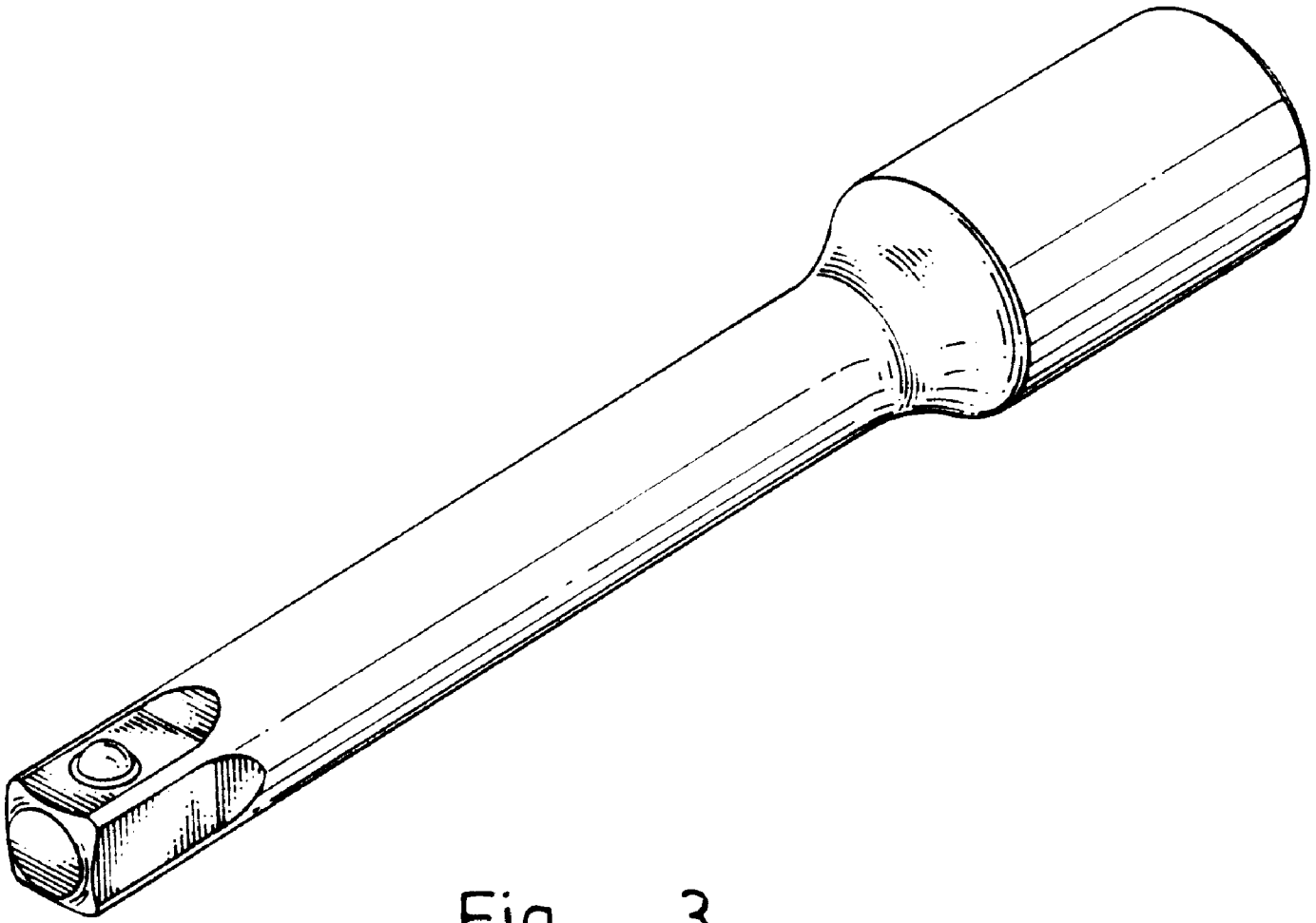
Fig. 3 PRIOR ART
FIG. 3 is a perspective view of a socket adapter for a ratchet socket wrench according to the prior art.
Figure 4:
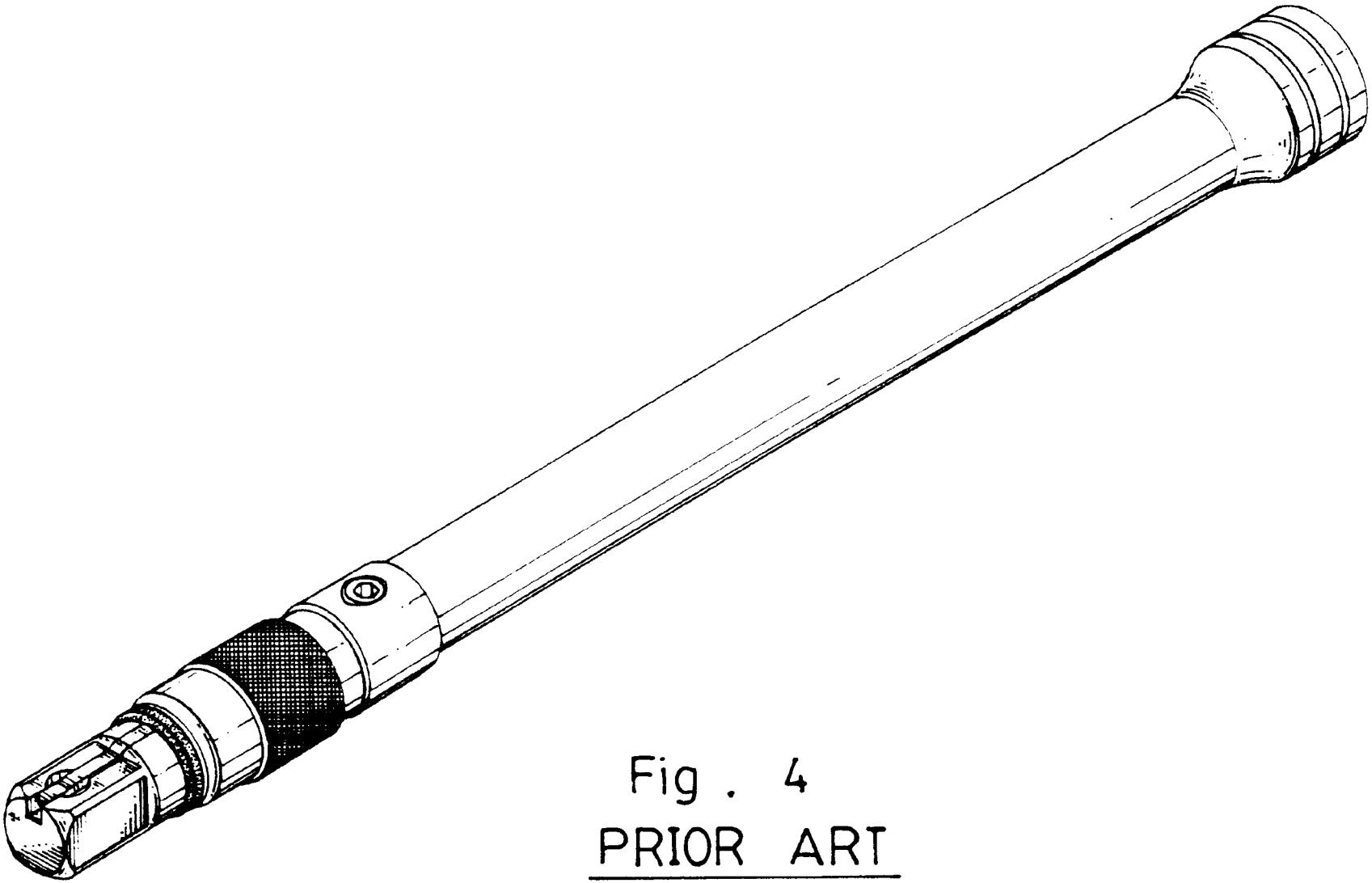
Fig. 4 PRIOR ART
FIG. 4 is a perspective view of another socket adapter for a ratchet socket wrench according to the prior art.
Figure 5:
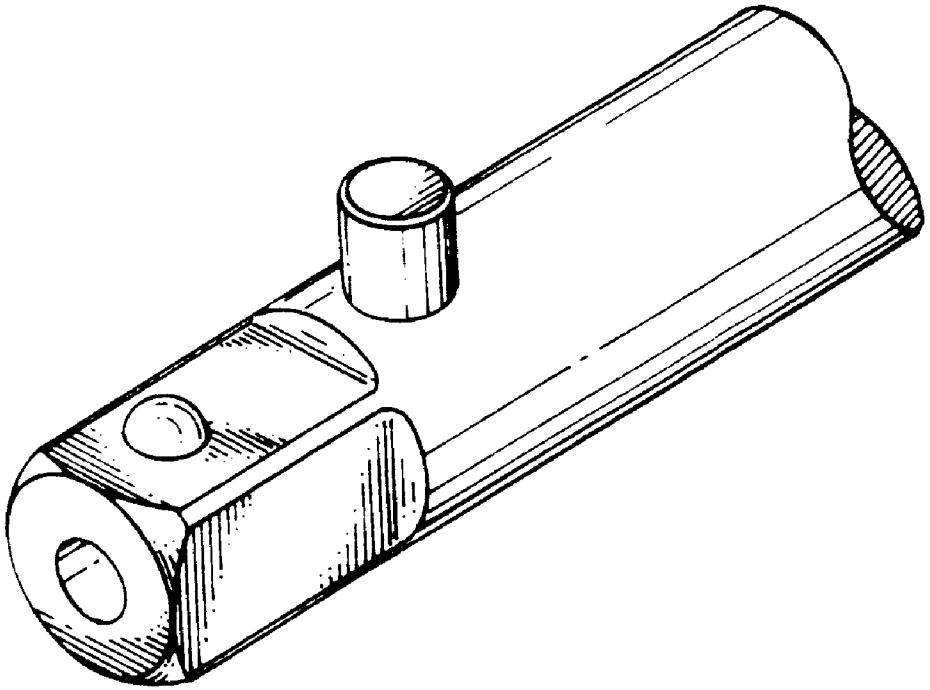
Fig. 5 PRIOR ART
FIG. 5 is a perspective view of still another socket adapter for a ratchet socket wrench according to the prior art.
Figure 6:
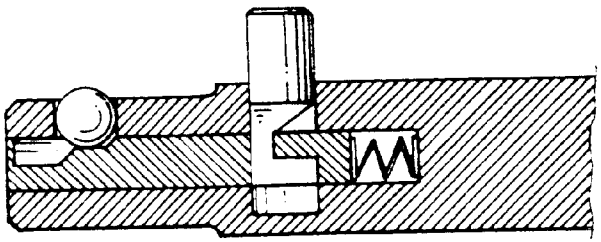
Fig. 6 PRIOR ART
FIG. 6 is a sectional view of FIG. 5.
Figure 7:
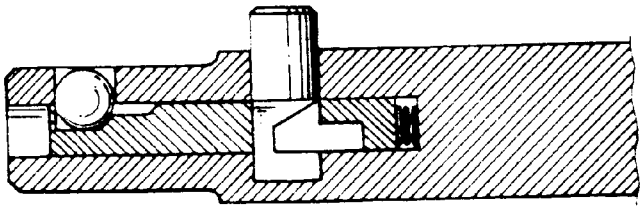
Fig. 7 PRIOR ART
FIG. 7 is similar to FIG. 6 but showing the release control rod depressed, the steel ball received in the radial hole on the polygonal front end of the adapter.
Figure 8:
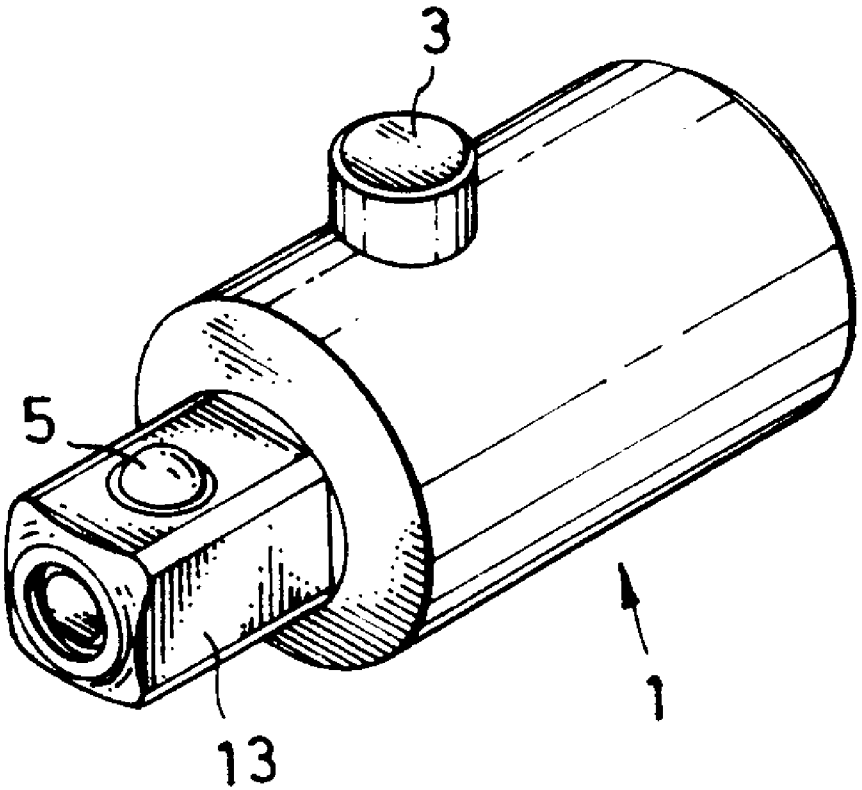
FIG. 8 is a perspective view of a quick-release socket adapter according to one embodiment of the present invention.
Figure 9:
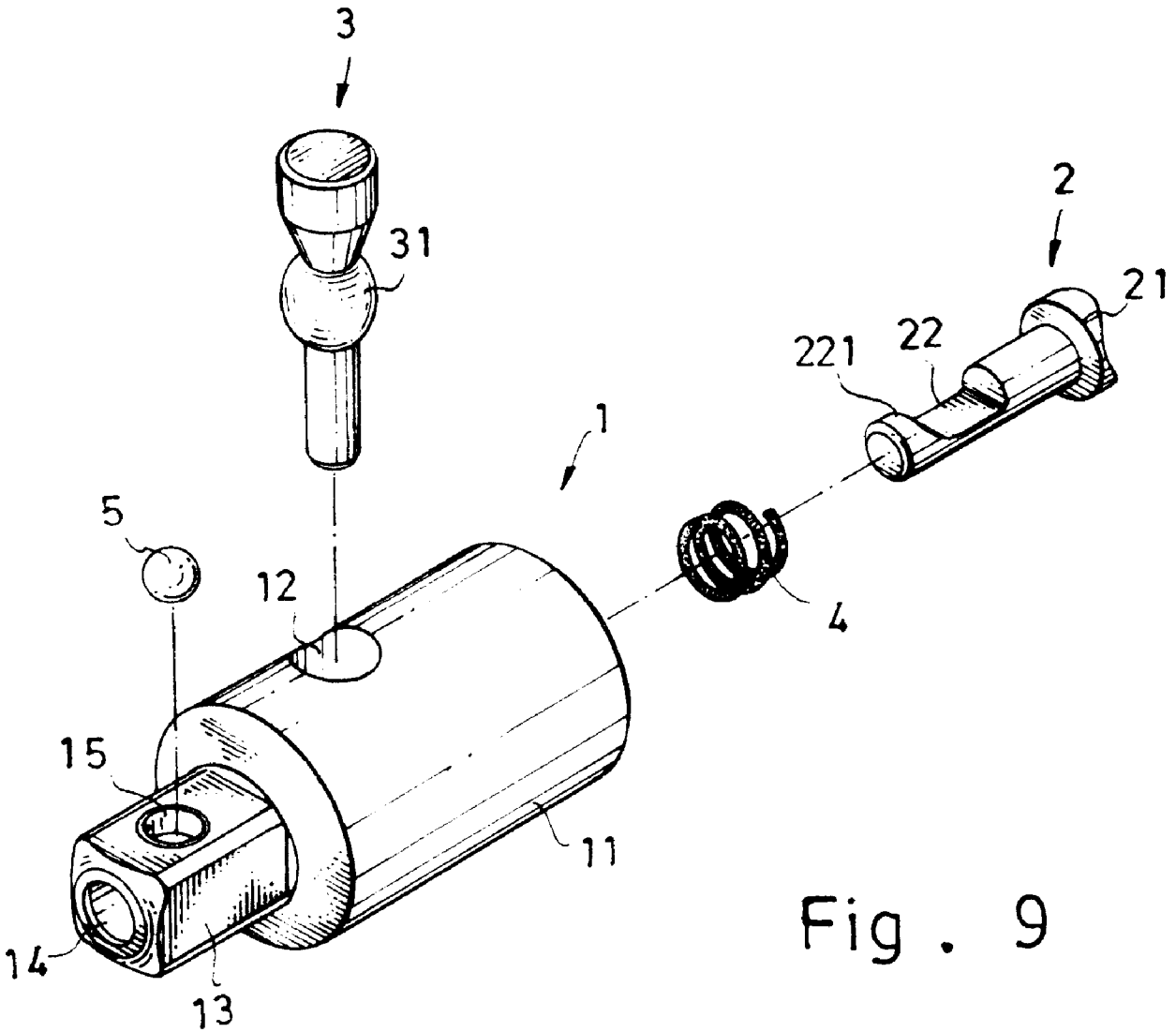
FIG. 9 is an exploded view of the quick-release socket adapter shown in FIG. 8.

Referring to Figures from 8 to 10, a quick-release socket adapter in accordance with the present invention is generally comprised of an elongated casing 1, a stop rod 2, a release control rod 3, a spring 4, and a steel ball 5.

The casing 1 comprises a hollow cylindrical ratchet socket wrench coupling portion 11 at one end for coupling to a ratchet socket wrench, a polygonal coupling rod 13 longitudinally integral with one end of the hollow cylindrical ratchet socket wrench coupling portion 11, a transverse through hole 12 transversely pierced through the hollow cylindrical ratchet socket wrench coupling portion 11 which receives the release control rod 3, a longitudinal through hole 14 pierced through the longitudinal central axis of the polygonal coupling rod 13 in communication with the inside space of the hollow cylindrical ratchet socket wrench coupling portion 11 which receives the stop rod 2, and a radial locating hole 15 perpendicularly extended from the longitudinal through hole 14 to the periphery of the polygonal coupling rod 13 which receives the steel ball 5. The transverse through hole 12 is comprised of two longitudinally aligned sections of different diameters.

The stop rod 2 is inserted into the longitudinal through hole 14 of the casing 1, having a recessed head 21 at one end, and a peripheral notch 22 at the periphery remote from the head 21. The head 21 of the stop rod 2 has a diameter greater than the diameter of the longitudinal through hole 14. The stop rod 2 is inserted through the inside space of the hollow cylindrical ratchet socket wrench coupling portion 11 into the longitudinal through hole 14, enabling the head 21 to be moved with the stop rod 2 in the inside space of the hollow cylindrical ratchet socket wrench coupling portion 11 outside the longitudinal through hole 14 of the polygonal coupling rod 13. The peripheral notch 22 receives a part of the steel ball 5, and a has a sloping work edge 221 at one end.

The release control rod 3 is a cylindrical rod fitting the transverse through hole 12 on the hollow cylindrical ratchet socket wrench coupling portion 11 of the casing 1, having a rounded flank 31 curved outwards on the middle.

The spring 4 is mounted around the stop rod 2, and stopped between the head 21 of the stop rod 2 and a step between the inside space of the hollow cylindrical ratchet socket wrench coupling portion 11 and the longitudinal through hole 14. When installed, the spring 4 imparts an outward pressure to the head 21 of the stop rod 2, causing the recessed top wall of the head 21 to be forced into engagement with the flank 31 of the release control rod 3.

The steel ball 5 is mounted in the radial locating hole 15, and forced by the stop rod 2 to project partially out of the outside wall of the polygonal coupling rod 13 of the casing 1.

Figure 11:
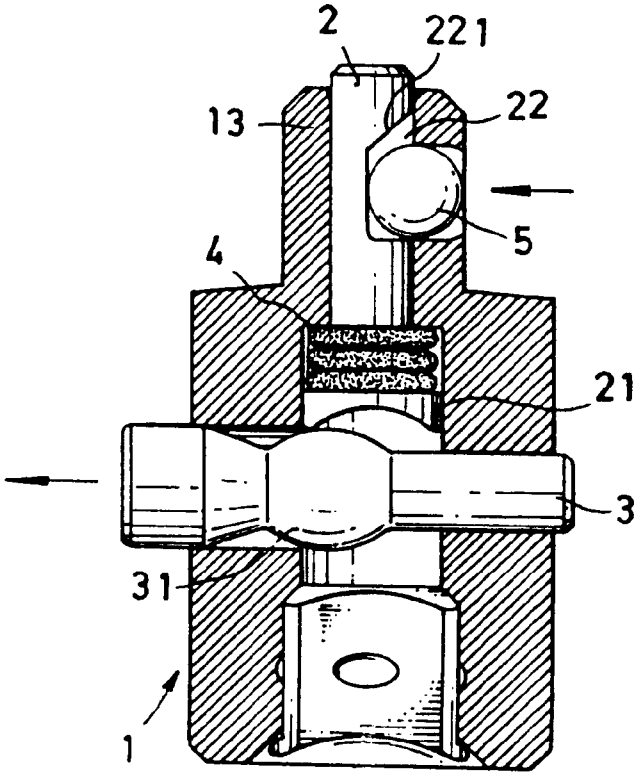
FIG. 11 is similar to FIG. 10 but showing the release control rod moved in one direction, the stop rod pushed forwards, the spring compressed, the steel ball received in the radial locating hole on the polygonal coupling rod of the casing.
Figure 10:
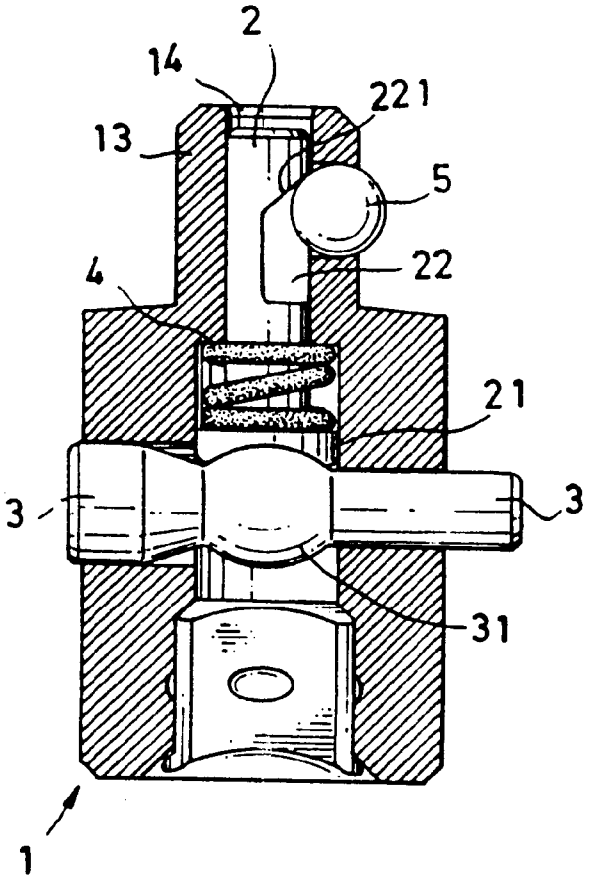
FIG. 10 is a longitudinal view in section of FIG. 8.

Referring to FIGS. 11 and 10 again, when a socket is sleeved onto the polygonal coupling rod of the casing 1, the steel ball 5 is forced inwards in the locating hole 15, enabling the socket to be coupled to the polygonal coupling rod 13. When the steel ball 5 is forced inwards, it imparts a downward pressure to the sloping work edge 221 of the peripheral notch 22 of the stop rod 2, thereby causing the stop rod 2 to be forced forwards. When the stop rod 2 is forced forwards, the spring 4 is compressed by the head 21 of the stop rod 2. After the socket has been set into position and released from the hand, the stop rod 2 is pushed back by the spring power of the spring 4, and the steel ball 5 is partially forced out of the locating hole 15 by the sloping work edge 221 into engagement with the loaded socket, causing the loaded socket to be firmly secured to the polygonal coupling rod 13 of the elongated casing 1. When disconnecting the socket from the polygonal coupling rod 13 of the casing 1, the release control rod 3 is pushed with the hand in one direction to disengage the flank 31 from the recessed top wall of the head 21 of the stop rod 2, causing the stop rod 2 to be forced forwards by the flank 31 of the release control rod 3, and therefore the spring 4 is compressed by the rounded head 21 of the stop rod 2, and at the same time the steel ball 5 is lowered along the sloping work edge 221 to the bottom of the peripheral notch 22 of the stop rod 2 and released from the loaded socket (see FIG. 11), enabling the loaded socket to be freely removed from the square front end of the cylindrical base 13 of the elongated casing 1.

Figure 12:
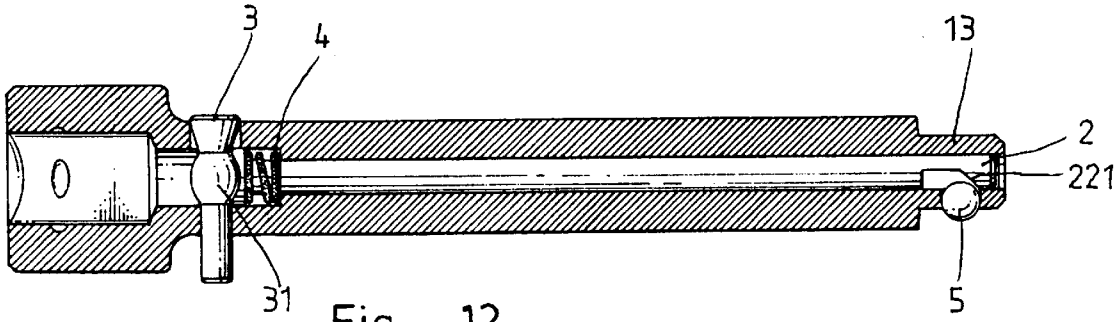
FIG. 12 is a sectional view of an alternate form of the present invention.

FIG. 12 shows an alternate form of the present invention, in which the casing has a hollow cylindrical connection portion connected between the polygonal coupling rod and the hollow cylindrical ratchet socket wrench coupling portion.

Figure 13:
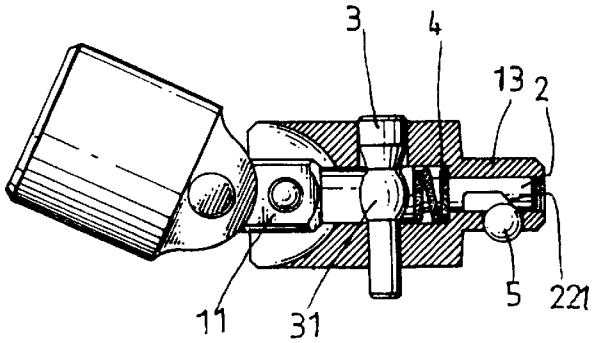
FIG. 13 shows the present invention integral with an universal connector.

FIG. 13 shows another alternate form of the present invention, in which the socket adapter is integral with an universal connector.

Figure 14:
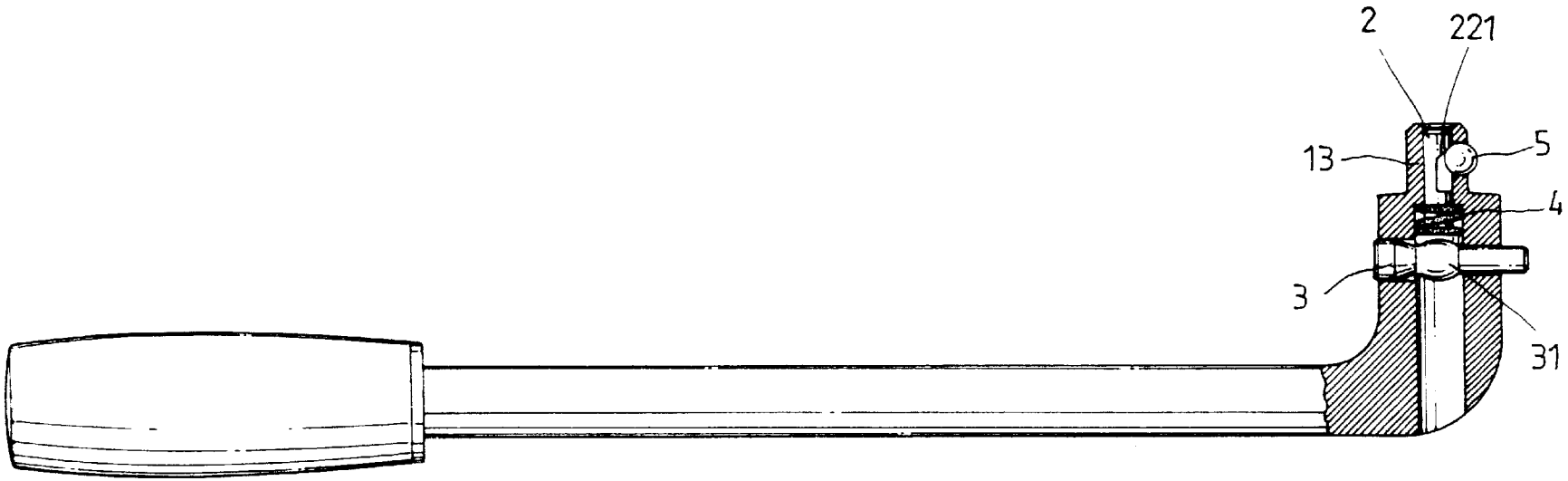
FIG. 14 shows the present invention integral with a L-shaped spanner.

FIG. 14 shows still another alternate form of the present invention, in which the socket adapter is integral with a L-shaped spanner.

Figure 15:
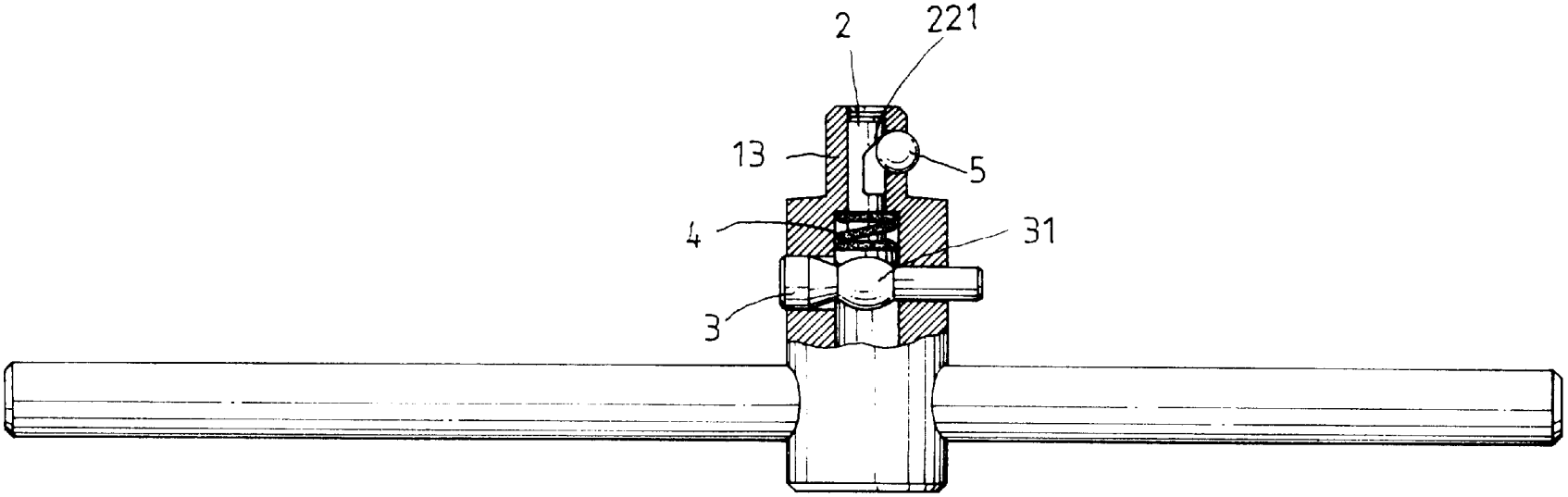
FIG. 15 shows the present invention integral with a crossed spanner.

FIG. 15 shows still another alternate form of the present invention, in which the socket adapter is integral with a crossed spanner.

It is to be understood that the drawings are designed for purposes of illustration only, and are not intended as a definition of the limits and scope of the invention disclosed.

I claim:

1. A quick-release socket adapter comprising a casing having a hollow polygonal coupling rod at one end for holding a socket, a hollow ratchet socket wrench coupling portion at an opposite end for coupling to a ratchet socket wrench, a steel ball moved in and out of a radial locating hole on said polygonal coupling rod for securing the socket mounted on said polygonal coupling rod, a spring mounted inside said casing, a stop rod inserted into said hollow ratchet socket wrench coupling portion and said hollow polygonal coupling rod and forced by said spring to push said steel ball out of said radial locating hole into engagement with the socket mounted on said polygonal coupling rod of said casing, and a release control rod controlled to release said stop rod from said steel ball, enabling said steel ball to fall into the inside of said radial locating hole and to disengage from the socket mounted on said polygonal coupling rod, wherein said hollow ratchet socket wrench coupling portion of said casing has a transverse through hole, said transverse through hole having two sections of different diameters; said stop rod has a head at one end moved with said stop rod in said hollow ratchet socket wrench coupling portion; said spring is mounted around said stop rod and stopped between the head of said stop rod and an inside step between said hollow ratchet socket wrench coupling portion and said hollow polygonal coupling rod; said release control rod is inserted in said transverse through hole on said hollow ratchet socket wrench coupling portion, said release control rod having a flank on a middle thereof moved with said release control rod in said transverse through hole between a first position where the head of said stop rod is forced by said spring into engagement with said flank and said steel ball is partially forced out of said radial locating hole by said stop rod, and a second position where the flank of said release control rod forces a part of the head of said stop rod forwards, causing said spring to be compressed and said steel ball to fall in said radial locating hole away from the socket mounted on said polygonal coupling rod.

2. The quick-release socket adapter of claim 1 wherein the head of said stop rod has a recessed top wall for receiving the flank of said release control rod.

3. The quick-release socket adapter of claim 1 wherein said release control rod has two sections of different diameters respectively longitudinal extended from said flank in reversed directions and respectively fitting the two sections of different diameters of said transverse through hole.

* * * * *